US007744090B1

(12) United States Patent
Nettle

(10) Patent No.: US 7,744,090 B1
(45) **Date of Patent: *Jun. 29, 2010**

(54) ARCHERY TARGET METHOD AND APPARATUS

(76) Inventor: Robert Nettle, 29076 Highway 190 West, LaCombe, LA (US) 70445

( * ) Notice: Subject to any disclaimer, the term of this patent is extended or adjusted under 35 U.S.C. 154(b) by 0 days.

This patent is subject to a terminal disclaimer.

(21) Appl. No.: 12/277,222

(22) Filed: Nov. 24, 2008

Related U.S. Application Data

(63) Continuation of application No. 10/935,787, filed on Sep. 7, 2004, now abandoned.

(51) Int. Cl.
*F41J 3/00* (2006.01)

(52) U.S. Cl. ..... 273/403

(58) Field of Classification Search ..... 273/403, 273/404, 407, 408
See application file for complete search history.

(56) References Cited

U.S. PATENT DOCUMENTS 4,203,600 A * 5/1980 Brown ..... 273/407
4,643,434 A * 2/1987 Carlin ..... 273/408
5,503,403 A * 4/1996 Morrell ..... 273/403
6,068,261 A * 5/2000 Nettle ..... 273/408
6,254,100 B1 * 7/2001 Rinehart ..... 273/403
6,575,469 B2 * 6/2003 Love ..... 273/403
6,926,281 B1 * 8/2005 Woock ..... 273/403
7,455,298 B1 * 11/2008 Nettle ..... 273/403
2002/0113372 A1 * 8/2002 Love ..... 273/408
2002/0145256 A1 * 10/2002 McKenzie et al. ..... 273/404
2004/0140623 A1 * 7/2004 Pulkrabek ..... 273/408

* cited by examiner

*Primary Examiner*—Mark S Graham
(74) *Attorney, Agent, or Firm*—Andrew Vicknair

(57) ABSTRACT

A three dimensional, animal-shaped archery target molded of polyurethane foam in two members consisting of a body member and a head member. The body member having a cavity therein for containing a replaceable target insert retained in place by a replaceable, sliding foam panel conforming externally to the shape of the animal located on one or both sides of the target insert thereby fully concealing the insert. A repairable clay core insert or various replaceable target inserts may be used including foam or packed cotton.

23 Claims, 5 Drawing Sheets

ARCHERY TARGET METHOD AND APPARATUS

1. CROSS-REFERENCE TO RELATED APPLICATIONS

This is a Continuation-In-Part application relying on applicant's previously filed Continuation-In-Part application Ser. No. 11/890,237 filed on Aug. 4, 2007, which is a Continuation-In-Part application relying on applicant's previously filed non-Provisional application Ser. No. 10/935,787 filed Sep. 7, 2004 under 35 USC 120.

2. FIELD OF THE INVENTION

This invention relates generally to archery targets and more particularly to free standing 3-D foam animal targets with replaceable target inserts with indestructible cores.

3. GENERAL BACKGROUND

Three dimensional animal archery targets have been in use nearly since the advent of urethane foam compositions. As foam mixtures improved so have archery targets. Currently such targets utilize high-density cellular foam molded into a variety of animal shapes. Such targets are relatively lightweight and fabricated in one piece or in several replaceable sections. The foam targets are generally sufficient to allow several hundred shots using target point, field point or broadhead tipped arrows. However, due to damage to the cellular structure from numerous arrow shots, the target or at least some portion of the target must be replaced usually each year at considerable expense. The degree of damage and the area affected depends on the hunter's choice of arrow types and ability to concentrate shots in the kill zone. Therefore, it becomes obvious that the area of the target with the most concentrated damage should be replaceable and kept to a minimum size to reduce cost.

Three-dimensional animal archery, targets are widely used by bow hunters to perfect their hunting skills beyond simply hitting the target. Such realistic targets are used to inspire the archer and hone his skills in striking the animal in its vital organs. In many cases, compromises are made in the pursuit of realism, particularly in the context of target choices. The archer's preference of form over function can make an object intended to improve archery skills impractical. Practice with highly destructive broadhead-tipped arrows, in preparation for hunting, requires that archers, desiring to use 3-D targets, must choose between expensive targets that are unable to sustain the damage inflicted by broadheads or the even more expensive sectional targets requiring frequent replacement of the vital organ section.

Even 3-D animal targets with replaceable inserts, when used with Broadhead-tipped arrows, require frequent replacement inserts and eventual mid section replacement as well. Such inserts cause as many problems as they solve due their inability to provide sufficient stopping power for the arrow. In some cases mid barriers made of wood are used to prevent the arrow from going completely through the target. As the inserts become damaged due to multiple shots, they allow more penetration of the arrow thereby leading to target depletion, arrow pass-throughs, arrow damage, and dislodged and embedded broadheads (rendering the adjacent target area unusable due to the high potential for damage to subsequently shot arrows.

The above disadvantages and other drawbacks to using single piece or sectional 3-D animal targets with or without replaceable inserts emphasize the need for an indestructible or less expensive target assembly.

The prior art teaches the use of placing removable inserts within a body cavity. However, such teachings rely on wedged shaped cavities, alignment grooves and support rods passing through the body members and through the replaceable insert to secure the insert in place.

Other means for securing a replaceable insert in place have been suggested such as the use of straps or wire or perhaps a cloth or molded foam covers such as is taught by Morrell in U.S. Pat. No. 5,503,403.

An easily removable relatively inexpensive long lasting insert is therefore still needed for such three-dimensional animal targets. The following specification discloses a more functional long lasting insert that is virtually indestructible and a method for securing the insert in place within a natural looking three dimensional animal form.

Inserts for animal targets are well known within the art. However, such inserts are becoming more complex and thus must be carefully compared with regard to their longevity, stopping power and cost of replacement. Due to the advent of new more user friendly open face targets such as foam targets having clay cores, as is taught by Robert Nettle in U.S. Pat. No. 6,068,261, can now be used as inserts in three-dimensional animal target described herein. An insert having a core would both optimize and enhance the unique properties of clay as implemented in an archery target. When used in an open-face core configuration, those properties, namely clay's malleability and susceptibility to variation in ambient temperature and the heat generated during arrow impact, cause it to expand both outward and concentrically from the core's boundary during use; in effect, mushrooming forward and outward from its original borders. This occurs as a result of the kinetic energy absorbed during arrow impact and, also during arrow removal, due to the force necessary to break the vacuum seal forming around the arrow, as well as the act of pulling the arrow's broadhead-tipped blades backwards through the clay. Left uncorrected during use, by failing to periodically repack the core with a maul or even mash the clay back into the central core barehanded, expansion of the clay continues until enough extends beyond the core's boundaries to degrade its integrity in adequately stopping arrows to the point that the target backstop and rear foam wall eventually become subject to the penetration of arrows and, consequently, ultimate depletion.

Based on the correlation between the ambient temperature and malleability of the clay, when used in non-temperate conditions, after several hours the clay core has the potential to become degraded. Depending on the kinetic energy delivered by the bow, arrow and tip combination used, in extremes of heat, the core's ability to stop arrow penetration can be reduced to the extent that the backstop and rear foam layer are compromised; and in extremes of cold the clay's resistance to arrow penetration increases to the point of damaging arrow tips and shafts.

Lastly, when broadhead-tipped arrows are withdrawn from an open-faced clay core, trace amounts of clay are often found on the arrow shaft and along the back edges of the broadhead. This is generally consistent with the amounts of residue associated with removing broadhead-tipped arrows from polyurethane foam targets, however due to the adhesive properties of the clay and relative to the ambient temperature, may sometimes be more difficult to remove.

4. SUMMARY OF THE INVENTION

A three dimensional, animal-shaped archery target molded of polyurethane foam, microcellular foam, any type of expandable flexible foam, any type of rigid foam, and/or any combination thereof in one or more members, the body having a cavity or orifice therein for containing a replaceable target insert having a central core. Yet, the invention is not limited to an insert having a central core as the invention may be configured with an insert without a central core. For example, if the application of the present invention does not require a central core, such as when a user is shooting field tip arrows, then an embodiment of the present invention may be configured with an insert and no central core.

The insert retained within the cavity or orifice by replaceable, sliding foam panel conforming to the exterior contours of the animal located on one or both sides of the target insert thereby fully concealing the insert. A repairable clay core insert or various replaceable target inserts may be used including foam, compacted cotton, straw, other suitable materials or a combination thereof. In some embodiments, the invention may be configured so that the replaceable target insert is some type of vacuum compressed material which may be configured to include a central core or to not include a central core. The vacuum compressed material making up the replaceable target insert may comprise any one of more of a number of materials that are vacuum compressed, such as foam, cotton, straw, clay, rags, paper, sponges, grass, leaves, polyester, vinyl, silicone, gels, feathers, plastic bags, and the like.

Unlike other three dimensional foam animal targets utilizing inserts and/or replaceable core members and coverings, the instant invention utilizes a concealed insert having a compacted repairable core thereby making the vital organ kill zone of the target indestructible except for the inexpensive replaceable removable slide-in contoured external panels. The replaceable external panels also provide a way to help clean Broadhead-tipped arrows when being withdrawn from the compacted insert core material and further serve as way to hold the insert in position. The panels are also provided with engraved indicia defining the kill zone and vital organ areas.

While a preferred embodiment of the present invention is represented in a three dimensional, animal-shaped archery target, the present invention is not limited to a target that is in the shape of an animal. The present invention may also take the form of any geometrical shape, such as a square, rectangle, circle, triangle and the like. In such an embodiment, the non-animal shaped target may be block or circular shaped wherein the non-animal shaped target comprises a replaceable target insert, with or without a core, and panels for concealing the replaceable target insert.

5. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

6. DETAILED DESCRIPTION OF THE PREFERRED EMBODIMENT

Figure 1:
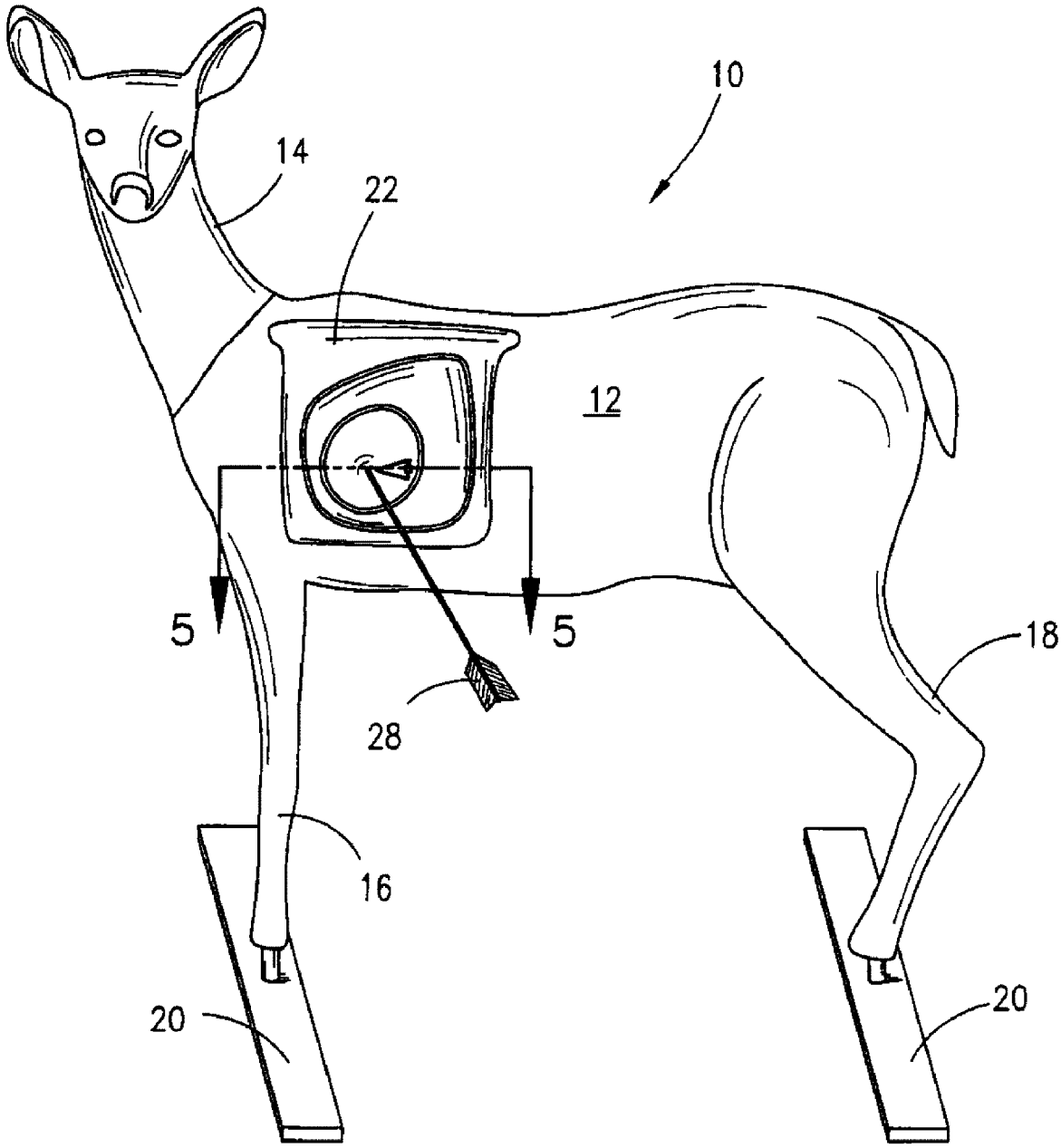
FIG. 1 is a front isometric view of the preferred embodiment.

Three-dimensional animal targets may take any animal shape. However, for discussion purposes the improved strike zone insert is described herein as related to a deer shaped target as sown in FIG. 1. In this case the three dimensional target 10 takes the form of a foamed-in-place deer shape composed of two basic elements, a body portion 12 and a removable head portion 14. The three dimensional target 10 is preferably molded of polyurethane foam, microcellular foam, any type of expandable flexible foam, any type of rigid foam, and/or any combination thereof. However, the present invention is not limited to the use of foam as the present invention may be configured so that the archery target (whether in animal shape or non-animal shape) may be comprised of plastic, rubber, steel, metal, fiberglass, wood, and/or foam or any combination thereof depending on the use. For example, if the archery target were in use for competition, it may be configured so that only the strike zone is foam and the remainder of the target is comprised of a material other than foam such as, wood, steel, plastic, fiberglass, cement, and the like. The body portion 12 is vertically supported upon two front and two rear legs 16,18 combined into a column connected to horizontal boards 20. The front and rear legs may be a single column as shown in FIG. 1 or have all four legs separated and supported on the front and rear boards 20.

Figure 2:
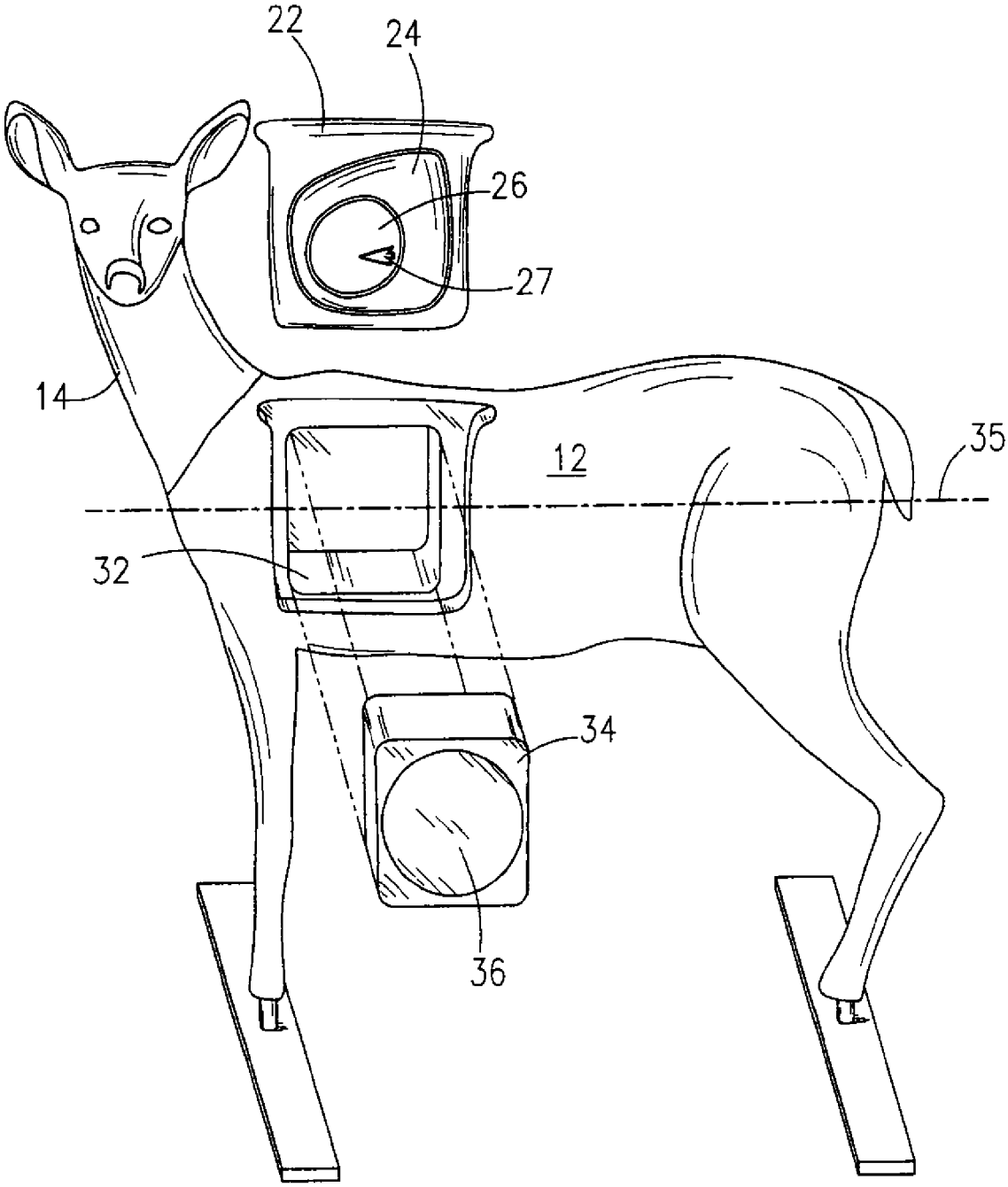
FIG. 2 is an expanded view of the insert and front retaining panel relative to the 3-D foam animal target.

A removable foam kill zone cover panel 22 having an exterior shape conforming to the external form of the deer body portion 12 is provided in the area of the kill zone located just behind the animal's front leg shoulder area, as seen in FIG. 2. The inexpensive replaceable panel 22 may also include indicia engraved therein 24,26 further defining the kill zone and location of vital organs, i.e. heart and lungs. An arrow 28 striking the indicia identified zone area 26 for example, as seen in FIG. 1, is considered a kill shot. Additional indicia may include an arrowhead symbol 27 or a scoring target/system officially sanctioned by one or more recognized archery organization.

Figure 3:
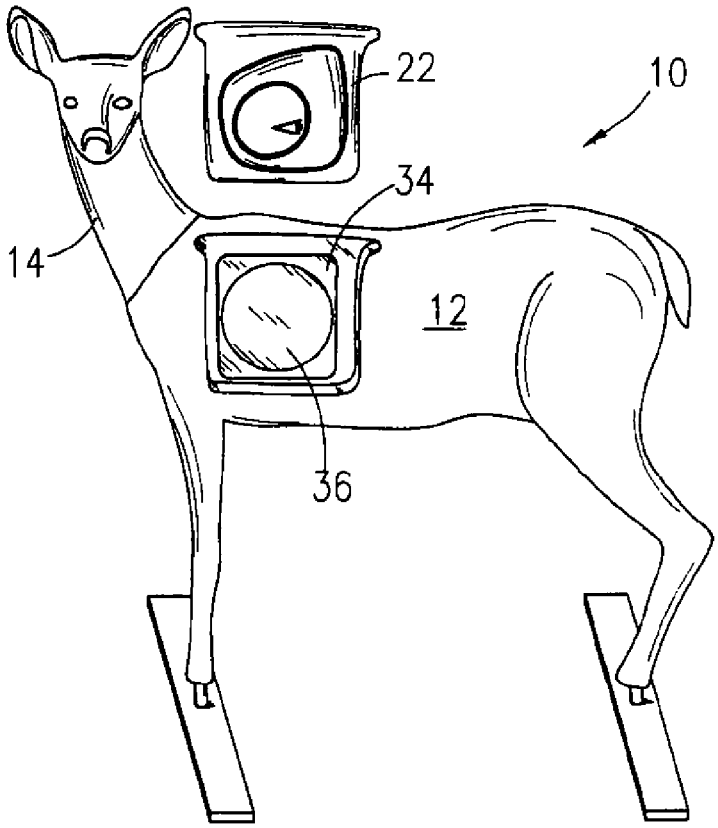
FIG. 3 is a front isometric view of the preferred embodiment with front insert retaining panel removed.
Figure 4:
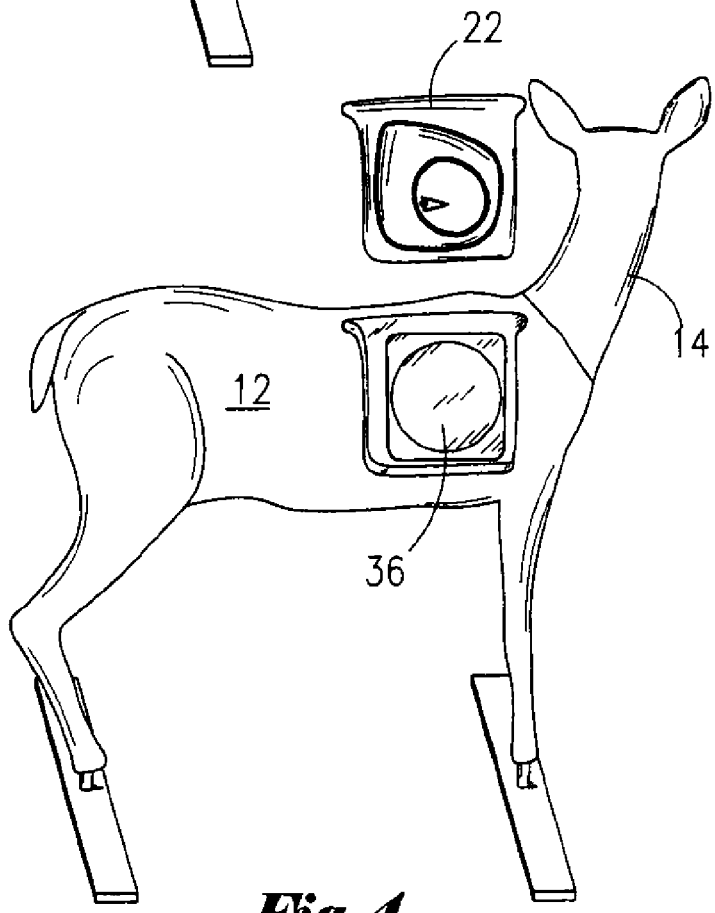
FIG. 4 is a rear isometric view of the preferred embodiment with rear insert retaining panel removed.
Figure 5:
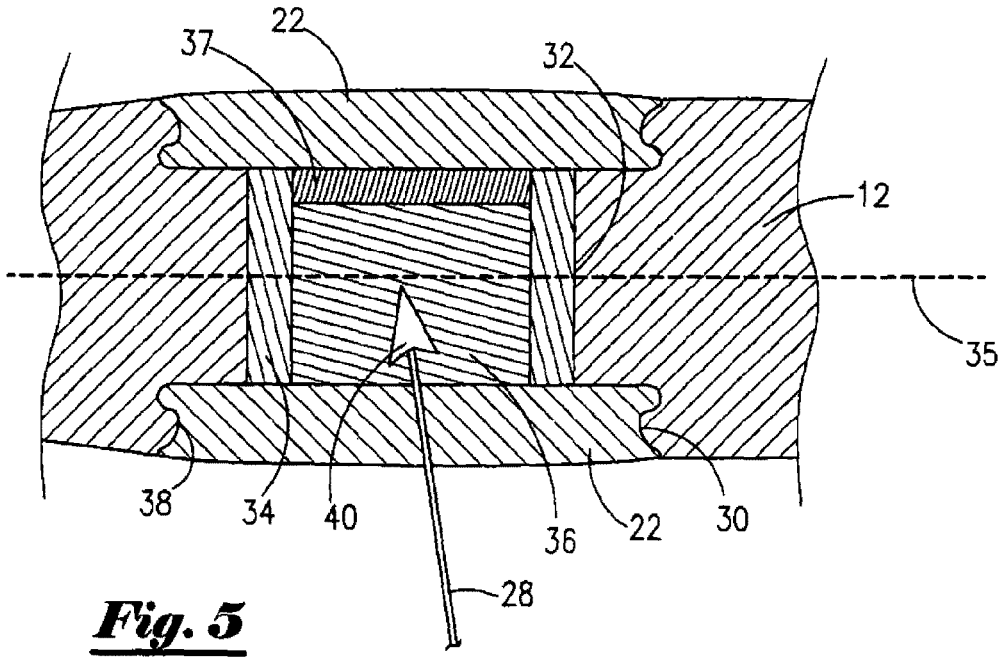
FIG. 5 is a cross-section view taken along the sight lines 5-5 shown in FIG. 1.

The panel 22 is provided with grooves 30, as seen in FIG. 5, located along each of its vertical sides conforming to cooperative ridges 38 formed within the body portion 12 to allow the panel 22 to be slidably removed vertically as shown in FIG. 3. The removable panels 22 form an integral part of the body portion 12. However, other methods may be employed for removal of such panels as well. A reverse image panel 22 may be provided on the reverse side of the target as seen in FIG. 4 to allow the target to be shot from either side.

As seen in cross-section in FIG. 5, a panel 22 that forms an integral part of the body 12 represents the kill zone. These slide out panels 22 cover the mouth of a passage or tunnel shown in FIG. 5 herein as extending clear through the body 12. Therefore, a panel 22 may be located at the mouth of each end of the tunnel or hole 32. Thereby, differing from other 3-D foam targets having channels cut into the body for receiving a plurality of foam panels. It should also be understood that a cavity as defined herein is an opening to a blind hole surrounded on all sides extending only partially through the body 12 and not simply a hollowed out portion of the target body. Describing a cavity is very difficult. However, the cavity or orifice herein is defined as an opening to a blind hole surrounded on all sides and extending inwardly perpendicular to the central vertical longitudinal plane 35 seen in FIG. 5. Most cavities located in foam animal targets are not surrounded on all sides and/or do not extend clear through the target perpendicularly to the central vertical longitudinal plane. Therefore, a single cavity may be employed for targets to be shot from only one side. However, the preferred embodiment has an orifice or cavity leading to a hole or tunnel 32 surrounded by the body 12, extending completely through the body 12 as seen in FIG. 2. The cavity, or orifice leading to the hole or tunnel 32 seen in FIG. 2 is located perpendicular to the longitudinal centerline 35 seen in FIG. 5.

A replaceable foam insert 34 conforming to the inside dimensions of the hole, tunnel 32, extending through and surrounded by the body 12 seen in FIG. 2, is provided for insertion within the hole, or tunnel 32. Foam insert 34 also includes a pliable reconfigurable central core material 36 having a higher density than the foam insert 34 and body portion 12. Yet, the invention is not limited to an insert including a central core 36 as the invention may be configured with an insert 34 without a central core. In such a configuration, insert 34 of FIG. 2, may be configured as a solid block with no central core 36. For example, if the application of the present invention does not require a central core, such as when a user is shooting field tip arrows into the three dimensional target 10, then an embodiment of the present invention may be configured with a solid insert 34 without the central core 36. This is advantageous as it gives the end user a choice to utilize an insert with or without a core depending on the user's preference In addition, insert 34 is not limited to foam as it may comprise any one or more of a number of materials, such as foam, cotton, straw, carpet, various combined fibrous materials, clay, rags, paper, sponges, grass, leaves, vinyl, silicone, gels, polyester, feathers, plastic bags, recycled materials and the like. Further, an embodiment of the present invention may be configured so that target insert 34 is some type of vacuum compressed material sized and shaped to fit within the hole, or tunnel 32. Such a vacuum compressed insert may be configured to include a central core 36 or to not include a central core. The vacuum compressed material making up target insert 34 may comprise any one of more of a number of materials that are vacuum compressed, such as foam, cotton, straw, clay, rags, paper, vinyl, silicone, gels, sponges, grass, leaves, polyester, feathers, plastic bags, and the like. Use of such a vacuum compressed material as insert 34 is advantageous as the use of the vacuum configuration will increase the density of the insert to help in preventing an arrow from penetrating all the way through insert 34. Use of different materials for inserts is advantageous as a user may have several inserts that can be made up of different materials and configurations (with or without a central core) and the user can swap inserts depending on the user's preferences. In addition, insert 34 may be configured so that it appears as illustrated in FIG. 2 with a core 36, but core 36 may comprise the same material as insert 34 and in such an embodiment, the user can remove core 36 and utilize a core comprised of a different material depending on the user's preferences.

This central core material 36 is important in that it must have sufficient density to stop the arrow from penetrating the entire target yet soft enough to prevent damage to the arrow itself. Various types of core materials 36 may be used for this purpose, including highly compacted clay, cotton, straw, or any suitable material or preferably a combination thereof. In some embodiments, the present invention may be configured so that the central core 36 is made up of a vacuum compressed member that contains any one or more of a number of materials, such as clay, cotton, straw, rags, paper, sponges, foam, vinyl, silicone, gels, grass, leaves, polyester, feathers, and the like. Use of such a vacuum compressed material as core 36 is advantageous as the use of the vacuum configuration will increase the density of the core. In such an embodiment, the vacuum compressed member would be positioned within insert 34 and may be configured with such a high density that it is capable of preventing arrows from penetrating through insert 34. With different types of cores 36, a user may also choose to utilize one insert 34 and simply change core 36 and use a core comprised of a different material depending on the user's preference. Thus, the present invention allows a user to change inserts and/or change cores or both depending on a user's preference.

Arrow penetration of the foam panel 22 is insufficient in and of itself to stop an average arrow shot. Therefore, the core material 36 located within the insert 34 must absorb the arrow's velocity without damage to the arrow 28 thus, a compacted core material may be necessary.

The compacted core material 36 located within the foam insert 34 in this case absorbs the velocity of the arrow and is retained within the hole or tunnel 32 by at least one of the removable cover panels 22. Where the animal target 10 is fitted with removable panels 22 on both sides of the insert, the removable panels 22, as shown in FIG. 5, retain the insert 34 and its core material 36.

Use of broad-head tipped hunting arrows tends to make arrow 28 recoveries very difficult. In many cases broadheads become entangled in the fibrous fill used in most target core material. In some cases heat generated during penetration of the target core by high-speed carbon arrows, actually become fused in such core material, thus leaving large holes in the target when removed or leaving an unusable portion of the target core when dislodged from the shaft of the arrow. Such embedded broad-heads pose a safety hazard and potential damage to subsequent arrow shots. By using a clay core 36, or cotton, straw etc. combination as the central core material 36, removal of the arrow's broadhead from the core 36 through the panel 22 tends to ensure that the core's material remains within the foam insert 34. The external panel 22 further tends to remove any core material 36 residue from the arrow shaft and tip as shown in FIG. 5, upon withdrawal thereby retaining the core material 36 within the insert 34. The fact that a clay core material or combinations thereof is reparable makes the insert 34 containing such core material easily repairable and thus virtually indestructible. Other repairable highly compacted compositions may be used as the core material 36 if desired and is thus fully anticipated by the invention.

Figure 6:
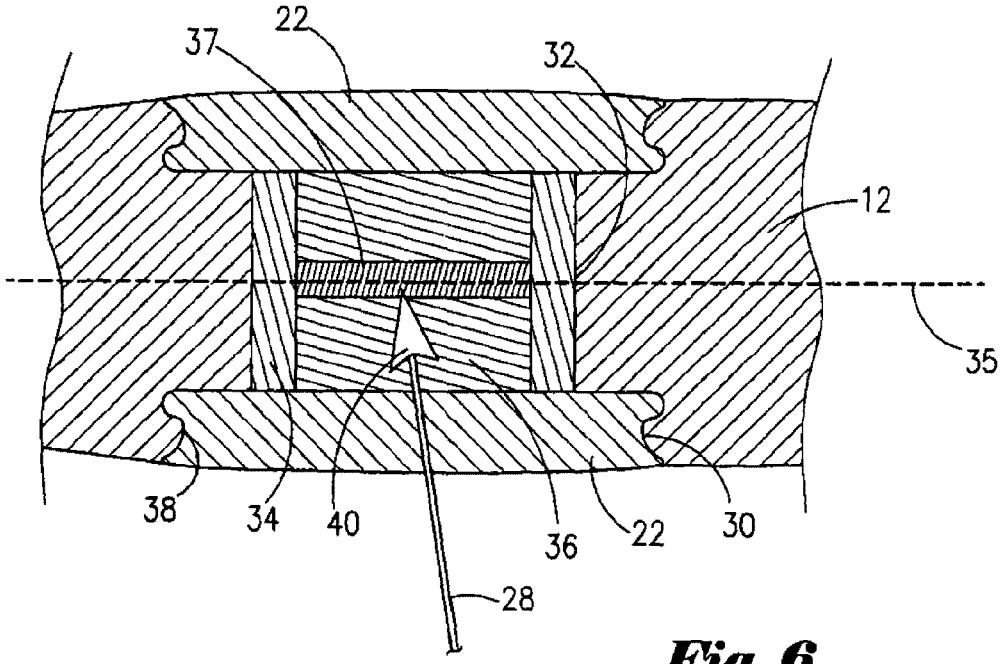
FIG. 6 is a horizontal plane cross-section view of the target taken along center line 35 seen in FIG. 2.

The replaceable foam panels 22, covering the insert 34 seen in FIG. 6 serves several functions. Encasing the clay core material 36 with the foam insert 34, overcomes its natural tendency of the core material 36 to expand both during the impact of penetrating arrows and during their extraction. These effects are redirected into a regenerative self-repairing wound healing action. Associated energies otherwise dissipated through the expansion of the clay based core material 36 beyond its borders have no path for release other than generating additional heat and internally compressing holes in the clay based material made by previous arrows having penetrated the core material, thereby enhancing the reparative properties of the clay.

With the insert 34 having a clay based core material 36 completely encased in a foam body the insulating properties greatly enhance the consistency of the clay during extremes of both heat and cold. This ensures a full day of usability and as an arrow is withdrawn from the target zone, upon exiting the boundary of the clay core material 36 the arrow must pass through the outer foam cover panel 22; the squeegee-like effect of being drawn through the foam removes most of the residual traces of the clay based material 36 clinging to the arrow shaft and tip 40.

In cases where it is impossible to provide a sufficient depth of the central clay based material core 36 to adequately stop an arrow, a high-density barrier 37 such as rubber may be used as a backup between the insert 34 and the removable panel 22 on the opposite side of the target being shot, as seen in FIG. 5. However, in some cases it may be beneficial to provide two inserts 34 laid end to end with a high-density barrier 37 located there between retained by an external panel 22 on each side to serve as a backstop if when shooting the target from either side.

The various embodiments described herein have described panel(s) 22 as comprised of foam. However, the present invention is not limited to such a configuration as alternative embodiments of the present invention may be configured so that panel(s) 22 may be comprised of one or more of plastic, rubber, steel, metal, fiberglass, vinyl, silicone, wood, and/or foam or any combination thereof depending on the use. For example, panel(s) 22 may be configured so that strike/kill zones 24 and/or 26 as illustrated in FIG. 2 are made of foam or other penetrable material while the remainder of panel(s) 22 are comprised of a different material such as fiberglass, wood, rubber, plastic, or the like.

Figure 7:
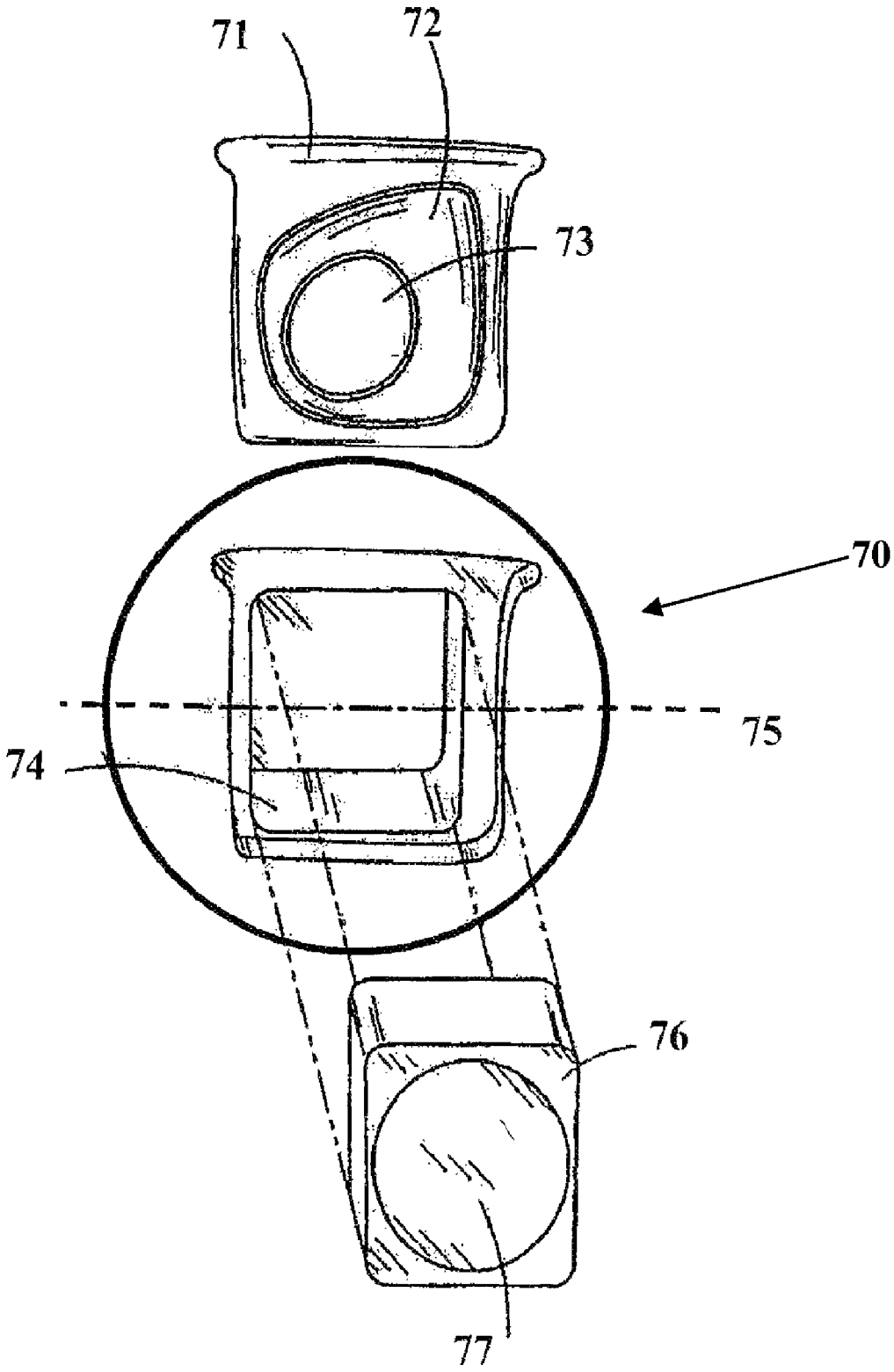
FIG. 7 is an expanded view of the insert and front retaining panel relative to the 3-D non-animal shaped target.

The discussions and drawings above reference a preferred embodiment when the archery target is in the shape of an animal. Yet, the present invention is not limited to the shape of an animal as an alternative embodiment of the present invention may be an archery target that takes a non-animal shape, such as a circular or block shaped target. For example, FIG. 7 illustrates such an embodiment when the archery target is non-animal shaped. Archery target 70, also described as a body member 70, in FIG. 7 is a circular shaped target with an orifice or cavity leading to a hole or tunnel 74, surrounded by the body of circular target 70, extending completely through the target. The cavity, or orifice leading to the hole or tunnel 74 is located perpendicular to the longitudinal centerline 75 seen in FIG. 7. In such an embodiment, there is a replaceable target insert 76 which may or may not include a central core 77. Replaceable target insert 76 that conforms to the inside dimensions of the hole, tunnel 74, extending through and surrounded by the body of circular target 70 seen in FIG. 7, is provided for insertion within the hole, or tunnel 74. As further illustrated in FIG. 7, target 70 may also be configured to include a removable strike zone cover panel 71 with grooves located along each of its vertical sides conforming to cooperative ridges formed within the target 70 to allow the panel 71 to be slidably removed vertically or horizontally. Panel 71 covers the mouth of a passage or tunnel 74 and also helps to retain insert 76 within target 70 while in use. Panel 71 may also be configured with exterior contours conforming to contours of said body member/target 70. The inexpensive replaceable panel 71 may also include indicia engraved therein 72, 73 further defining the strike zone and location of various points on target 70, such as a particular score or a bulls eye. Target 70 may also be configured to include two panels 71, such that there is one located on each side of target 70 to cover up tunnel 74 from both sides of the target 70.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A three-dimensional animal shaped archery target comprising:

a) a freestanding foam animal target having at least a body portion, said body portion having a defined kill zone;

b) a tunnel within said kill zone located horizontally and perpendicular to the vertical central longitudinal plane of said body portion extending though said body portion;

c) a foam insert member slidable within said tunnel;

d) a central longitudinal core located within said insert; and e) a slide-in foam panel defining said kill zone independently covering an opening to said tunnel forming an integral part of said foam body said panel having exterior three-dimensional contours conforming to contours of said foam body portion surrounding said panel and said slide-in foam panel further comprising grooves cooperative with ridges located within said body portion adjacent openings to said tunnel.

2. The three-dimensional animal shaped archery target according to claim 1 further comprising a removable barrier member located at one end of said tunnel.

3. The three-dimensional animal shaped archery target according to claim 1 further comprising a head member removably attached to said foam body portion.

4. The three-dimensional animal shaped archery target according to claim 1 further comprising four legs and a means for attaching said legs to horizontal support members.

5. The three-dimensional animal shaped archery target according to claim 1 wherein said slide-in foam panel further comprises external indicia engraved thereon, identifying said panels as said kill zone.

6. The three-dimensional animal shaped archery target according to claim 1 wherein said central longitudinal core extends the length of said insert.

7. The three-dimensional animal shaped archery target according to claim 1 wherein said central longitudinal core is comprised of one or more of:

a) clay;
b) cotton;
c) foam;
d) straw;
e) paper;
f) polyester;
g) feathers;
h) sponges;
i) plastic;
j) vinyl;
k) silicone;
l) gel.

8. The three-dimensional animal shaped archery target according to claim 1 wherein said central longitudinal core is comprised of a vacuum compressed material.

9. The three-dimensional animal shaped archery target according to claim 8 wherein said vacuum compressed material is comprised of one or more of:

a) clay;
b) cotton;
c) foam;
d) straw;

e) paper;
f) polyester;
g) feathers;
h) sponges;
i) plastic
j) vinyl;
k) silicone;
l) gel.

10. A three-dimensional animal shaped archery target comprising:

a) a freestanding animal target having at least a body portion, said body portion having a defined kill zone;
b) a tunnel within said kill zone located horizontally and perpendicular to the vertical central longitudinal plane of said body portion extending though said body portion;
c) an insert member slidable within said tunnel;
d) a slide-in panel defining said kill zone independently covering an opening to said tunnel forming an integral part of said body said panel having exterior three-dimensional contours conforming to contours of said body portion surrounding said panel and said slide-in panel further comprising grooves cooperative with ridges located within said body portion adjacent openings to said tunnel.

11. The three-dimensional animal shaped archery target according to claim 10 further comprising a central longitudinal core located within said insert.

12. The three-dimensional animal shaped archery target according to claim 11 further comprising a removable barrier member located at one end of said tunnel wherein said removable barrier member has a higher density than said insert member.

13. The three-dimensional animal shaped archery target according to claim 10 wherein said insert member is comprised of one or more of:

a) cotton;
b) foam;
c) straw;
d) paper;
e) polyester;
f) feathers;
g) sponges;
h) plastic
i) vinyl;
j) silicone;
k) gel.

14. The three-dimensional animal shaped archery target according to claim 10 wherein said insert member is comprised of a vacuum compressed material.

15. The three-dimensional animal shaped archery target according to claim 14 wherein said vacuum compressed material is comprised of one or more of:

a) clay;
b) cotton;
c) foam;
d) straw;
e) paper;
f) polyester;
g) feathers;
h) sponges;
i) plastic
j) vinyl;
k) silicone;
l) gel.

16. The three-dimensional animal shaped archery target according to claim 11 wherein said central longitudinal core is comprised of a vacuum compressed material.

17. The three-dimensional animal shaped archery target according to claim 16 wherein said vacuum compressed material is comprised of one or more of:

a) clay;
b) cotton;
c) foam;
d) straw;
e) paper;
f) polyester;
g) feathers;
h) sponges;
i) plastic;
j) vinyl;
k) silicone;
l) gel.

18. The three-dimensional animal shaped archery target according to claim 11 wherein said central longitudinal core is comprised of one or more of:

a) clay;
b) cotton;
c) foam;
d) straw;
e) paper;
f) polyester;
g) feathers;
h) sponges;
i) plastic;
j) vinyl;
k) silicone;
l) gel.

19. The three-dimensional animal shaped archery target according to claim 10 wherein said slide-in panel is comprised of one or more of:

a) foam;
b) plastic;
c) fiberglass;
d) rubber
e) vinyl;
f) silicone.

20. A three-dimensional archery target comprising:

a) a freestanding target having a body member, said body member having a defined strike zone;
b) a tunnel within said strike zone located horizontally and perpendicular to the vertical central longitudinal plane of said body member extending though said body member;
c) an insert member slidable within said tunnel;
d) a slide-in panel defining said strike zone independently covering an opening to said tunnel forming an integral part of said body member said panel having exterior contours conforming to contours of said body member surrounding said panel and said slide-in panel further comprising grooves cooperative with ridges located within said body member adjacent openings to said tunnel.

21. The three-dimensional archery target according to claim 20 further comprising a central longitudinal core located within said insert.

22. The three-dimensional archery target according to claim 21 wherein:

a) said insert member is comprised of a vacuum compressed material;
b) said central longitudinal core is comprised of a vacuum compressed material;

wherein said vacuum compressed material making up said insert member and said central core may be comprised of one or more of comprised of one or more of:

i) clay;
ii) cotton;
iii) foam;
iv) straw;
v) paper;
vi) polyester;
vii) feathers;
viii) sponges;
ix) plastic
x) vinyl;
xi) silicone;
xii) gel.

23. The three-dimensional archery target according to claim 21 wherein said insert member and said longitudinal core is comprised of one or more of:

i) clay;
ii) cotton;
iii) foam;
iv) straw;
v) paper;
vi) polyester;
vii) feathers;
viii) sponges;
ix) plastic;
x) vinyl;
xi) silicone;
xii) gel.

* * * * *